US007503579B2

(12) United States Patent
Couderc

(10) Patent No.: US 7,503,579 B2
(45) Date of Patent: Mar. 17, 2009

(54) DEVICE FOR RETAINING A FOOT OR BOOT ON A SPORTS APPARATUS

(75) Inventor: Bernard Couderc, Annecy (FR)

(73) Assignee: Salomon S.A., Metz-Tessy (FR)

( * ) Notice: Subject to any disclaimer, the term of this patent is extended or adjusted under 35 U.S.C. 154(b) by 326 days.

(21) Appl. No.: 11/038,080

(22) Filed: Jan. 21, 2005

(65) Prior Publication Data

US 2005/0167933 A1 Aug. 4, 2005

(30) Foreign Application Priority Data

Jan. 30, 2004 (FR) ..... 04 00903

(51) Int. Cl.
*A63C 9/00* (2006.01)

(52) U.S. Cl. ..... 280/623; 280/617; 280/11.36

(58) Field of Classification Search ..... 280/617, 280/618, 619, 620, 623, 624, 633, 634, 636, 280/11.3, 11.31, 11.36
See application file for complete search history.

(56) References Cited

U.S. PATENT DOCUMENTS 4,116,463 A * 9/1978 Zoor ..... 280/615
4,473,235 A * 9/1984 Burt ..... 280/11.36
5,261,689 A 11/1993 Carpenter et al.
5,356,170 A 10/1994 Carpenter et al.
5,692,765 A 12/1997 Laughlin
5,975,557 A * 11/1999 Snoke et al. ..... 280/624
6,283,482 B1 * 9/2001 Coulter ..... 280/14.22
6,581,944 B1 * 6/2003 Marmonier et al. ..... 280/14.22
6,722,688 B2 * 4/2004 Poscich ..... 280/618
2002/0117833 A1 8/2002 Farcot et al.
2004/0169350 A1 * 9/2004 Elkington ..... 280/623

FOREIGN PATENT DOCUMENTS

EP 0 793 920 A1 * 9/1997
FR 2 758 468 A1 7/1998

* cited by examiner

*Primary Examiner*—Frank B Vanaman
(74) *Attorney, Agent, or Firm*—Greenblum & Bernstein, P.L.C.

(57) ABSTRACT

A device for retaining a foot or a boot on a sports apparatus, such as a binding for a snowboard. The device includes a base plate associated with a rear support element/highback. The rear support element is movably mounted with respect to the base plate. A linkage is connected to the base plate and to the rear support element in order to limit the rearward movement thereof. The position of the rear support element with respect to the base plate is longitudinally adjustable.

31 Claims, 7 Drawing Sheets

Fig: 6
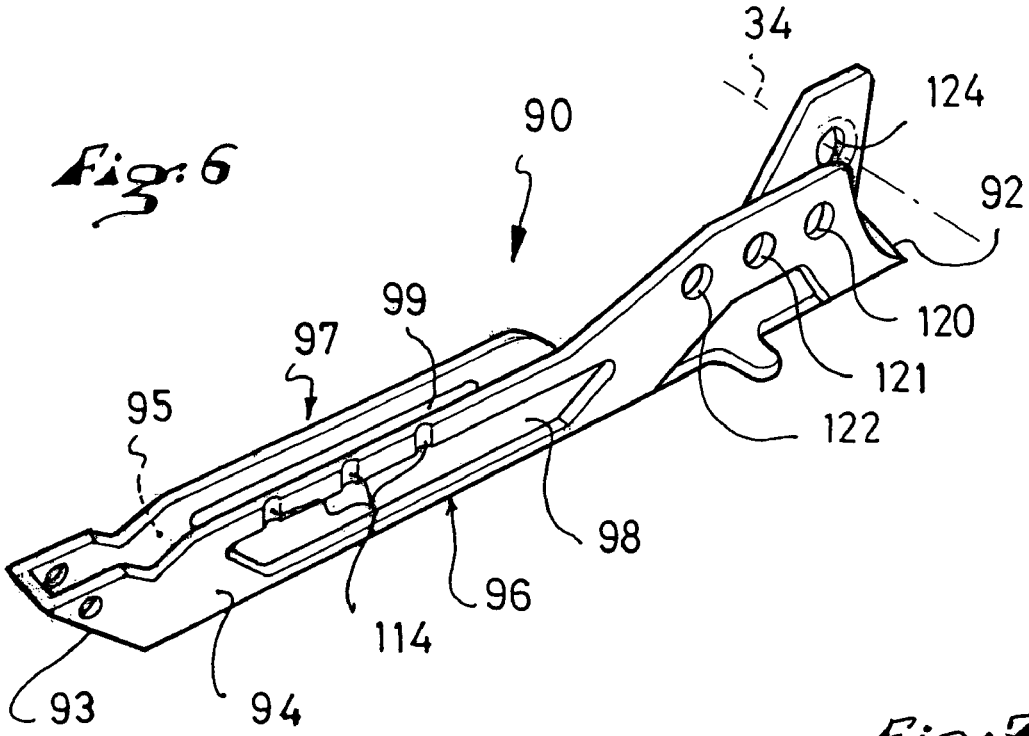
Fig: 7
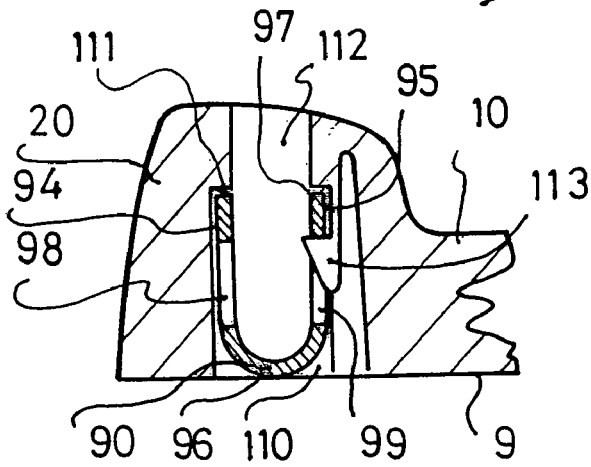
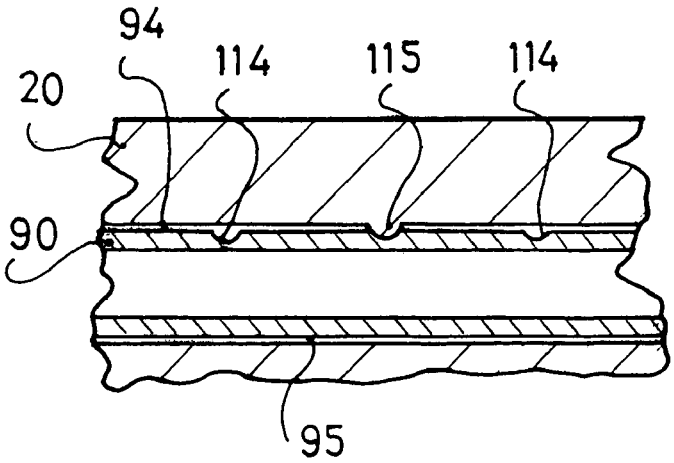
Fig: 8

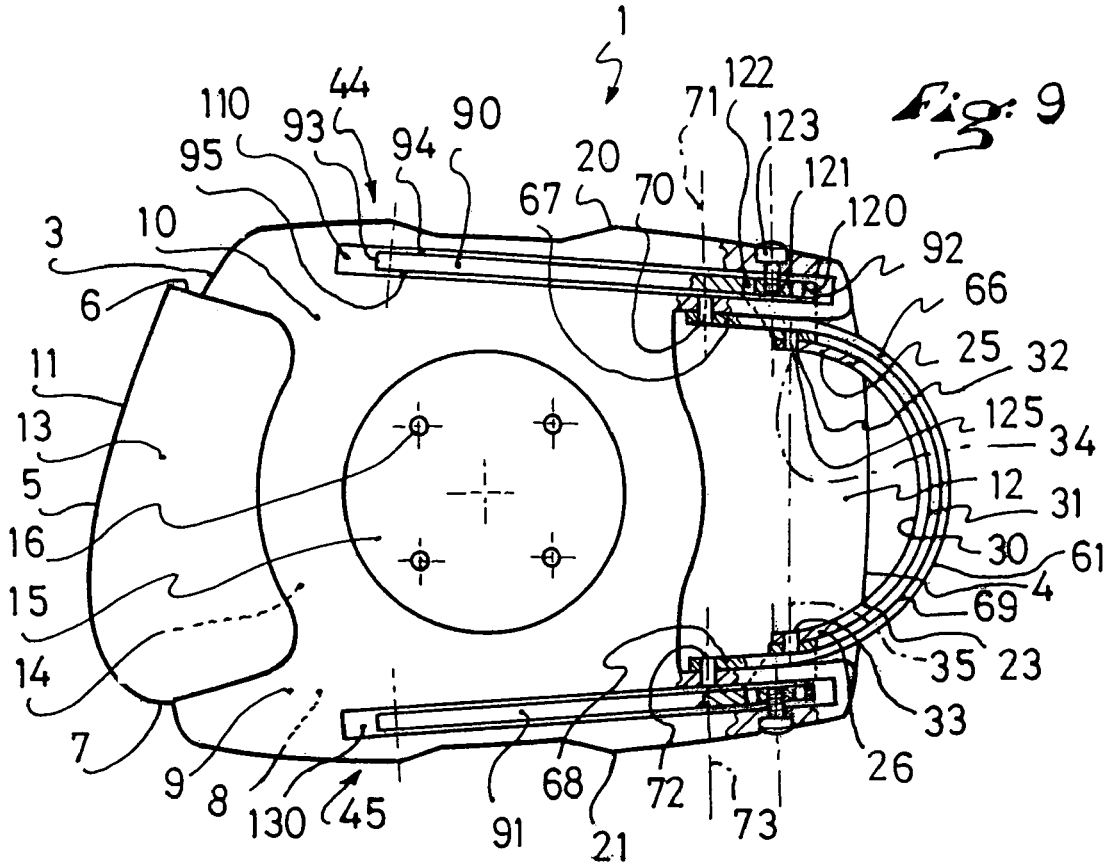
Fig: 9
Fig: 10
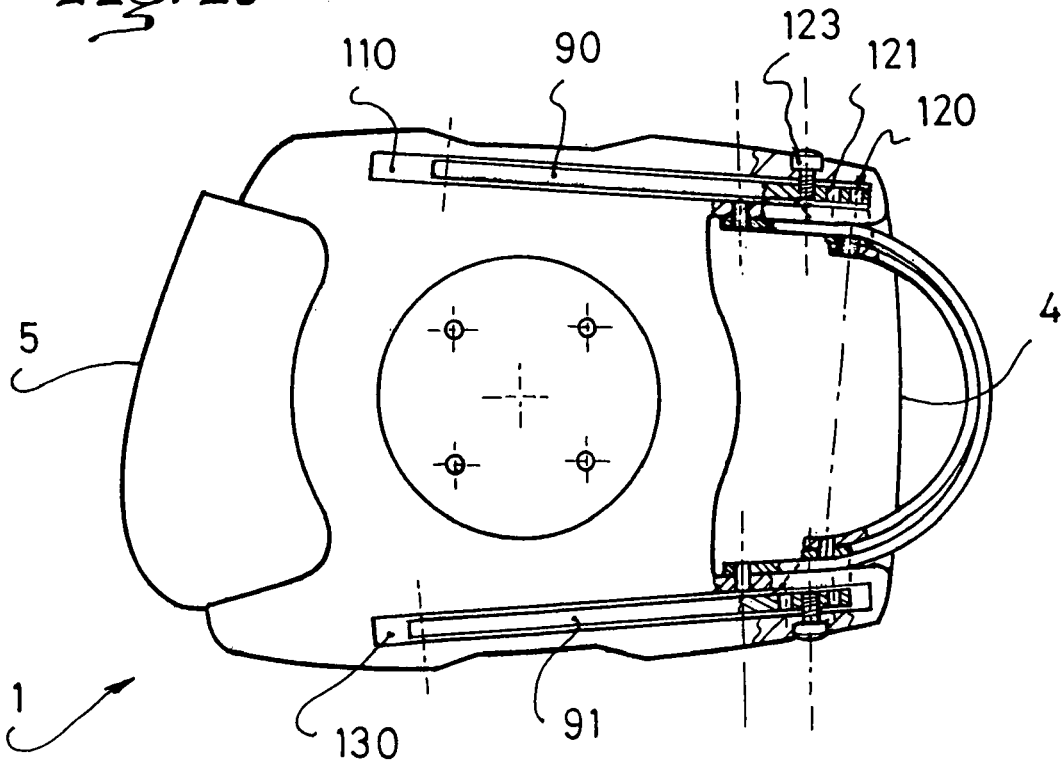

DEVICE FOR RETAINING A FOOT OR BOOT ON A SPORTS APPARATUS

CROSS-REFERENCE TO RELATED APPLICATION

This application is based upon French Patent Application No. 04.00903, filed Jan. 30, 2004, the disclosure of which is hereby incorporated by reference thereto in its entirety and the priority of which is hereby claimed under 35 U.S.C. §119.

BACKGROUND OF THE INVENTION

1. Field of the Invention

The invention relates to a device for retaining a foot or boot on a sports apparatus. More particularly, the device of the invention relates to a binding for receiving and retaining a foot or boot upon such sports apparatus.

Devices of this type are used for snowboarding, snow skiing, water skiing, snowshoeing, roller skating, and other activities and sports.

2. Description of Background and Relevant Information

Some prior art devices for use with sports apparatuses for the aforementioned activities/sports include a base plate to support the sole of the foot or the boot sole, as well as a rear support element, or highback, to support the user's lower leg. The base plate is associated with the rear support element as follows. First, the base plate extends lengthwise from a rear end to a front end. The rear support element has a fastening end opposite a free end, an articulation having a substantially transverse axis connecting the fastening end to the base plate. The articulation makes it possible to reduce the space requirement of the device for storage by enabling the rear support element to be tilted forward.

Finally, a linkage is connected to the base plate by a lower connection located at the front of the articulation, on the one hand, and to the rear support element by an upper connection located between the fastening end and the free end, on the other hand. The linkage limits the rearward rotation of the rear support element. Thus, the rear support element enables the transmission of sensory information between the user and the apparatus. More specifically, the lower leg can transmit or receive forces during the operation of the sports apparatus.

In the case of the sports apparatus being a snowboard, it is possible to press the lower leg rearwardly, with the lower leg supported rearwardly by the rear support element in order to apply a force to a running edge of the board.

However, for a given retaining device, or binding, the transmission of sensory information does not always occur with the greatest efficiency or effectiveness. Indeed, the particular physical characteristics of a user, in particular, his/her size, weight, and/or shoe size can influence the transmission of such sensory information. Moreover, each user can adopt a particular steering style, which also affects the transmission of sensory information.

As a result, the application of a certain force at the rear support element with the lower leg does not always produce the effect desired by the user. Sometimes, it is necessary to produce a substantial force in order to influence the behavior of the apparatus or snowboard. This can become physically tiring for the user, wearing him/her down. In other cases, conversely, the application of the slightest impulse can influence the behavior of the apparatus. This can prevent the user from controlling the steering of the apparatus/board properly, or as desired.

In snowboarding, a rear edge setting that requires a force that is too substantial can tire or wear down the rider. Conversely, if the rear edge setting can be undertaken with a slight effort, the slightest non-purposed force can adversely influence the behavior of the apparatus, i.e., contrary to the intention of the user.

Consequently, the forces generated by the apparatus and transmitted to the lower leg, via the rear support element, do not always reflect the behavior of the apparatus. The forces are sometimes excessive or insufficient.

SUMMARY OF THE INVENTION

An object of the invention in particular is to improve such a device and, for example, to render the device capable of transmitting sensory information more efficiently and effectively.

To this end, the invention includes a device for receiving a foot or a boot on a sports apparatus, the device having a base plate associated with a rear support element, the base plate extending lengthwise from a rear end to a front end, and widthwise from a first edge to a second edge, the rear support element being movably mounted for forward and rearward movement, such as rotation, with respect to the base plate, a linkage being arranged on the base plate and cooperating with the rear support element to limit the rearward movement of the rear support element.

The position of the rear support element with respect to the base plate, according to the invention, is adjustable longitudinally or substantially longitudinally. More particularly, the position of the rear support element with respect to the base plate is translationally longitudinally adjustable, or at least substantially translationally longitudinally adjustable.

An adjustment of the position of the rear support element can modify the position of the contact surface between the rear of the boot or leg and the rear support element.

Thus, the user can select the most suitable longitudinal position of the foot or boot with respect to the base plate. The position with respect to the base plate directly conditions the position of the foot or boot with respect to the apparatus.

Therefore, it is possible to select a foot or boot position for an efficient transmission of sensory information.

The resulting advantages are in particular the adaptability of the retention device to different users and the adaptability of the device to a given user who wishes to operate the apparatus in a different manner.

As a result, rear support with the lower leg substantially produces the desired effect for controlling/steering the apparatus, and a force generated by the apparatus substantially reflects the behavior of the apparatus.

BRIEF DESCRIPTION OF DRAWINGS

Other characteristics and advantages of the invention can be better understood by means of the following description, with reference to the attached drawings showing, by way of non-limiting examples, how the invention can be embodied, and in which:

FIG. 6 is a perspective view of a first slide of the device;

FIG. 7 is a cross-section along the line VII-VII of FIG. 5;

FIG. 8 is a cross-section along the line VIII-VIII of FIG. 5;

FIG. 9 is a schematic bottom view of the device, in a case where first and second fastening ends of the rear support element are in the same longitudinal position;

FIG. 10 is similar to FIG. 9, in a case where the first and second ends are offset longitudinally.

DETAILED DESCRIPTION OF THE INVENTION

Although the particular embodiment of the invention described hereinafter relates more particularly to the field of snowboarding, it is to be understood that the invention also is applicable, and thereby encompasses, other fields such as those mentioned above.

FIGS. 1-10 illustrate the aforementioned particular embodiment of the invention.

Figure 1:
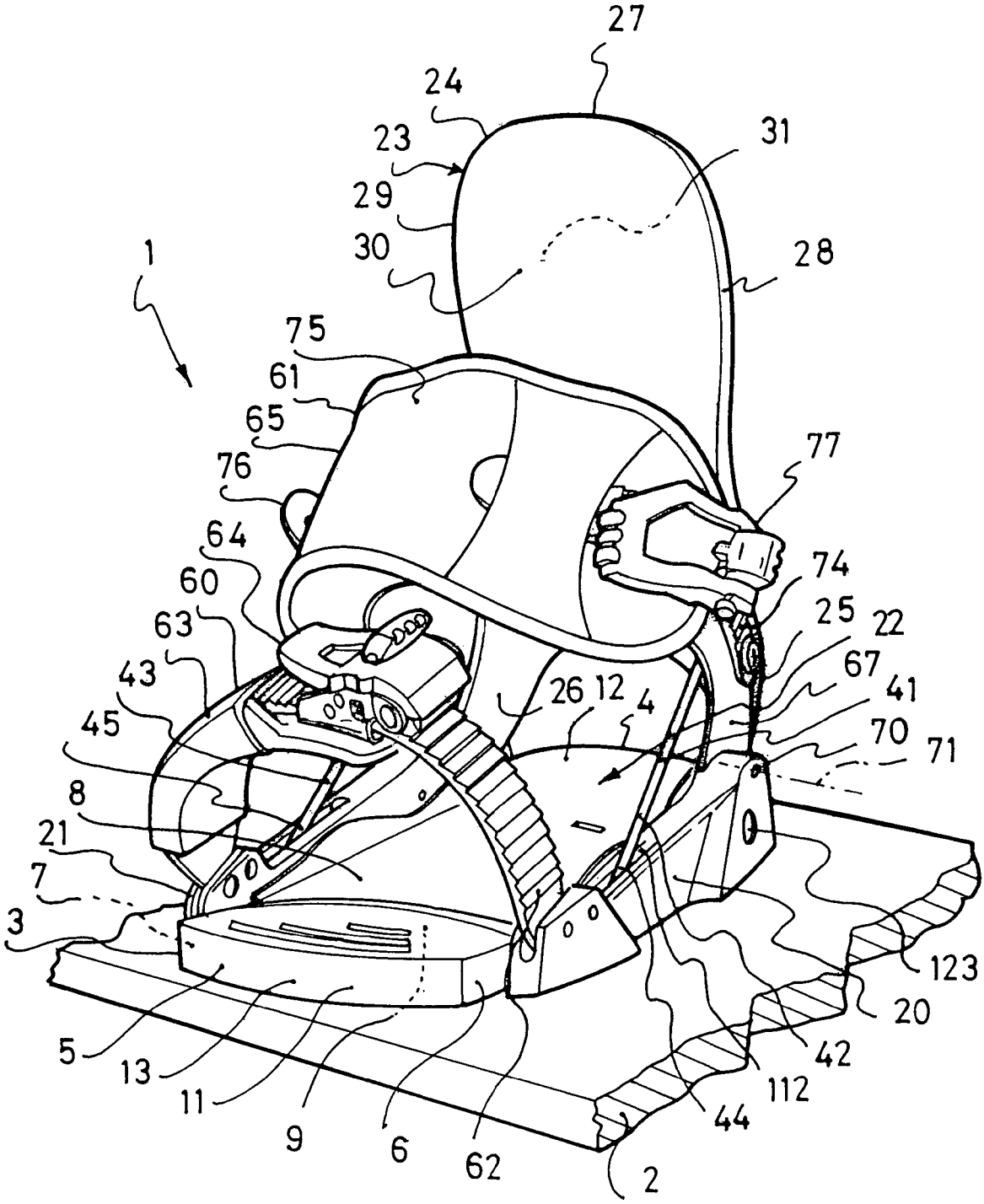
FIG. 1 is a perspective and top view of a retaining device/binding according to the invention.

As seen in perspective in FIG. 1, a receiving and retaining device 1, i.e., a binding, enables a boot (not shown) to be temporarily supported and retained on a snowboard 2.

In a known manner, the binding 1 has a base plate 3 that extends lengthwise between a rear end 4 and a front end 5, and widthwise from a first edge 6 to a second edge 7.

The base plate 3 has an upper surface 8 facing upwardly toward the sole of the boot, and a lower surface 9 facing downwardly toward the board 2.

As seen in FIG. 9, the base plate 3 includes a base 10 and a pad 11 for supporting the boot. The base 10 is a rigid element that at least partially demarcates the lower surface 9. The pad 11 at least partially demarcates the upper surface 8. According to the particular embodiment shown and described here, the pad 11 extends from the rear end 4 to the front end 5 of the base plate 3. This enables a dampened contact with the entire surface of the boot sole. A rear portion 12 and a front portion 13 of the pad 11 demarcate a storage space 14 for the base 10.

The invention also encompasses other structures for the base plate 3. For example, the base plate could include a base associated with two pads, longitudinally spaced apart, one at the rear and the other at the front.

The base plate 3 is retained on the board 2 by an arrangement in the form of a disk 15, which is fitted within a through opening in the base plate and engaged with a periphery thereof, which in turn is retained on the board 2 by a plurality of screws 16 extending through a plurality of holes in the disk and into the board. An assembly of the type disclosed in U.S. Patent Application Publication No. 2002/0117833 A1, published on Aug. 29, 2002, including of the type described in the background of that publication, could be used for retaining the base plate 3 on the board. For this purpose, the disclosure of U.S. Patent Application Publication No. 2002/0117833 A1 is hereby incorporated-by-reference thereto in its entirety.

The invention also encompasses other structures for retaining the base plate 3 on the board, particularly including those known to those skilled in the art.

As seen again in FIG. 1, the base 10 of the base plate 3 is laterally bordered by a first flange 20 and a second flange 21. In this case, the first flange 20 is a lateral flange and the second flange 21 is a medial flange, but it could be the opposite. Each of the flanges 20, 21 forms a lateral or medial portion, respectively, of the binding 1, so as to demarcate the zone 22 for receiving the boot. When the boot is in position on the binding 1, the flanges 20, 21 extend along the sides of the sole of the boot. Something other than the flanges 20, 21, as shown, could be provided to form the lateral or medial portions of the binding 1. For example, abutments could be used.

The base 10 and the flanges 20, 21 are shown as forming a single unitary element made of a synthetic material, for example. However, the invention encompasses the flanges 20, 21 in the form of elements that are affixed to the base by any suitable means, such as glue or other adhesive, welds, screws, by nesting, or other attachment(s).

The binding 1 also has a rear support element 23, or high-back, so that the user's lower leg can be supported rearwardly and enable him/her to apply forces via the lower leg as the binding is used, and to sense forces transmitted from the terrain over which the board traverses.

The rear support element 23 has a plate 24 that has a forward facing generally concave shape and that extends longitudinally between first 25 and second 26 fastening ends and a free end 27, transversely between a first edge or lateral edge 28 and a second edge or medial edge 29, and in thickness between a support surface 30, facing forwardly, and a free surface 31, facing rearwardly.

The support surface 30 is provided to receive the rear of the rider's lower leg, the rear support element 23 and the base 10 being consequently associated therewith.

Figure 3:
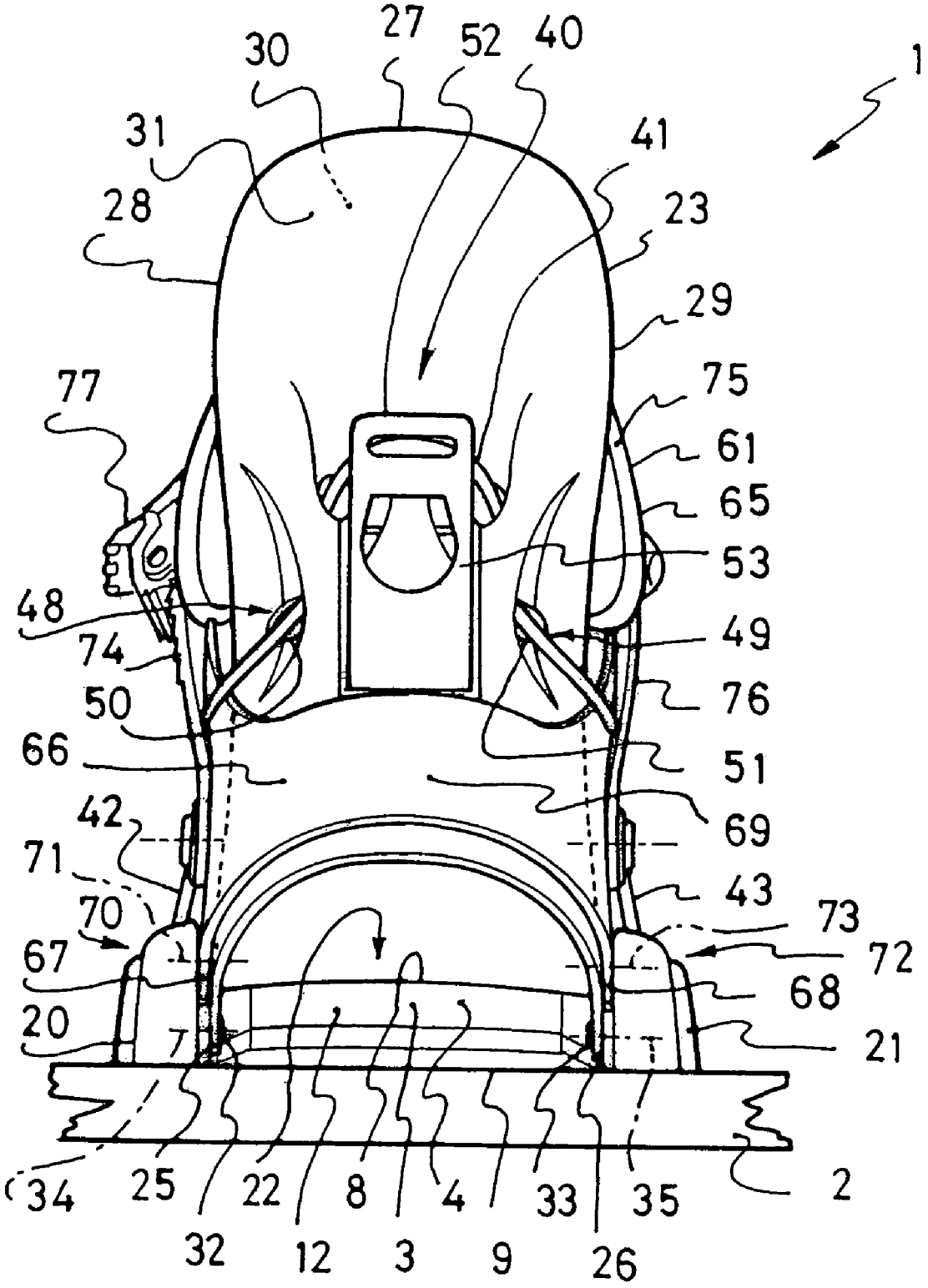
FIG. 3 is a rear view of the device.
Figure 4:
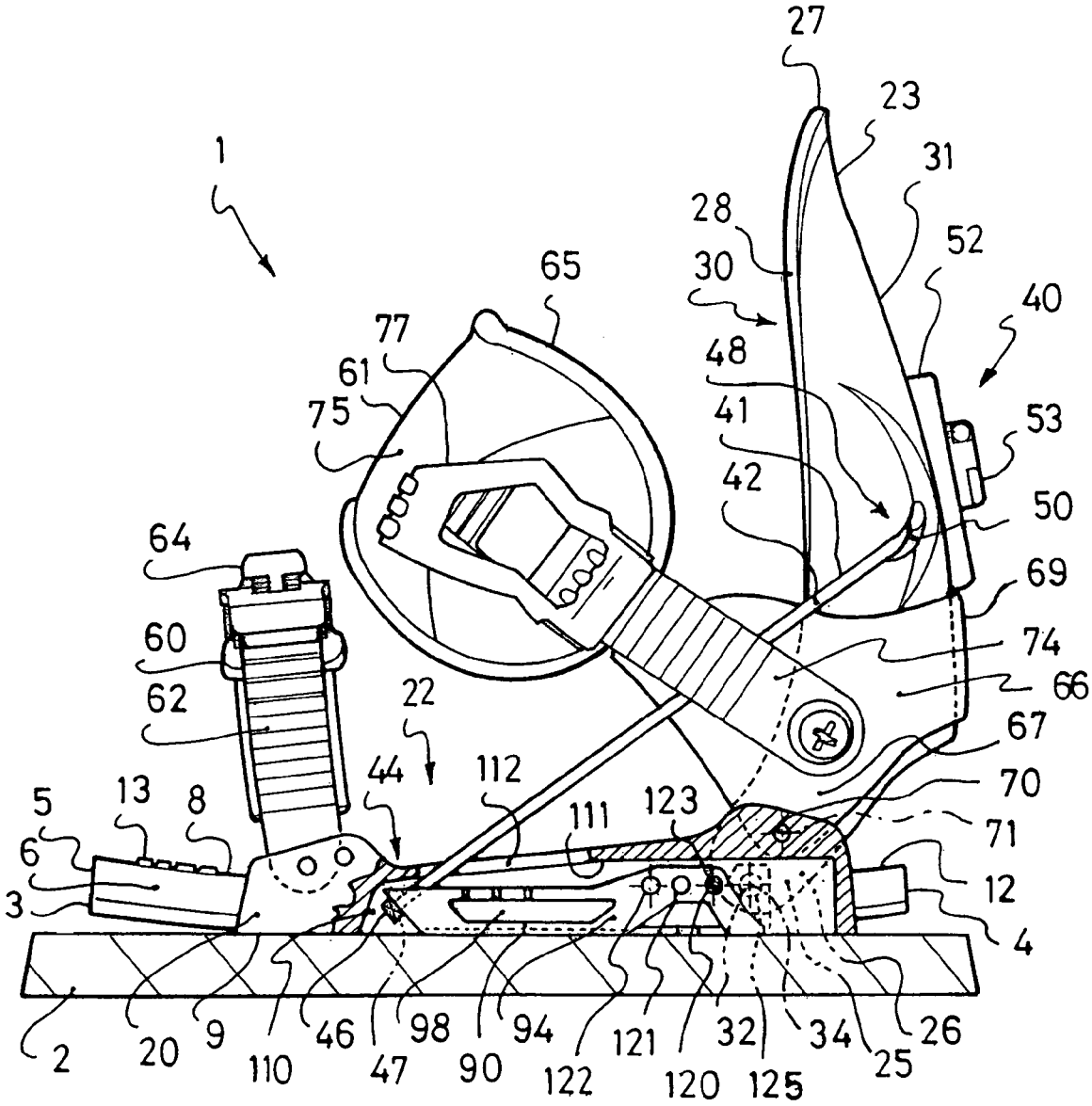
FIG. 4 is a side view of the device, in a case where the rear support element is moved forward.
Figure 5:
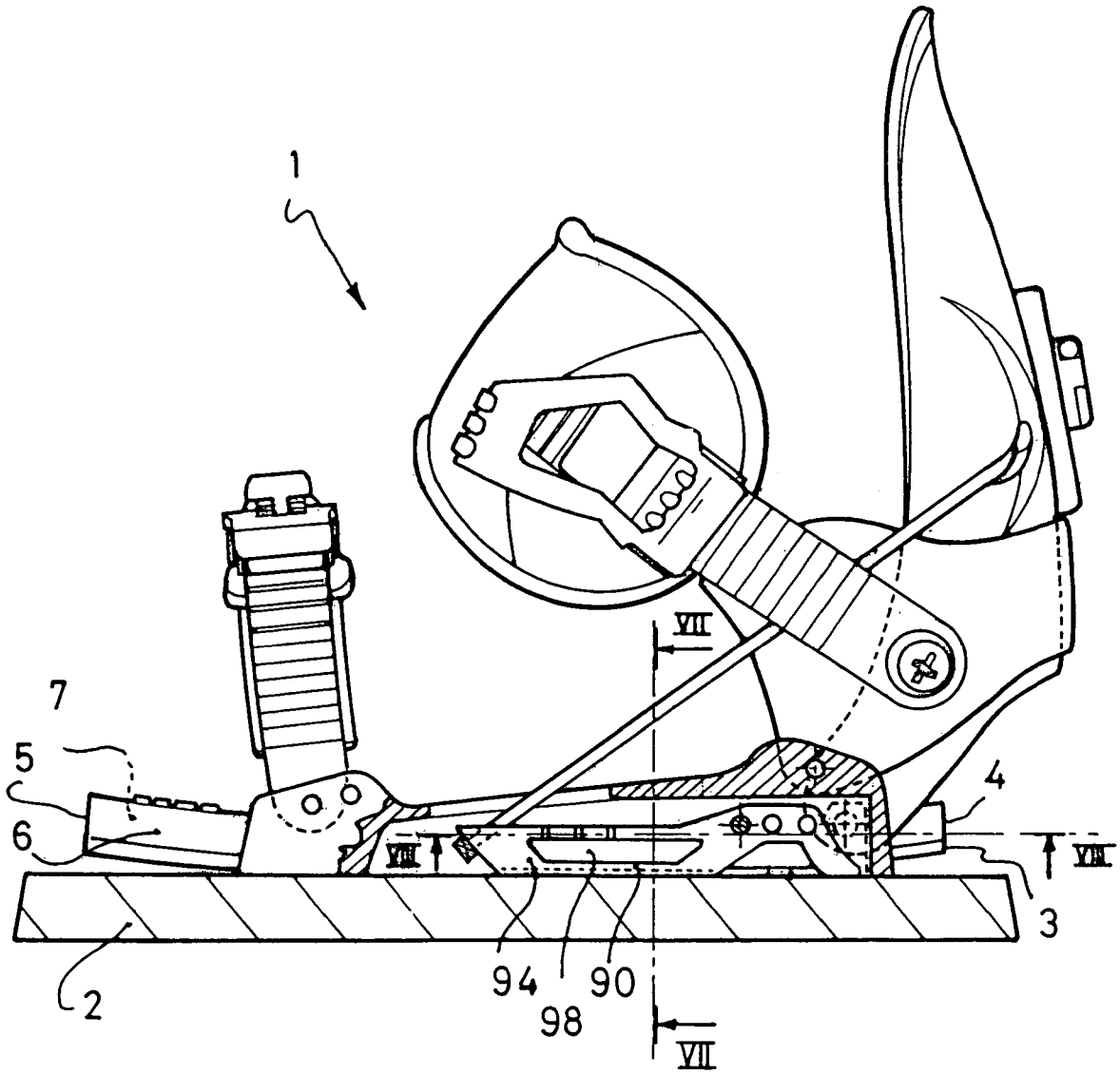
FIG. 5 is a view similar to FIG. 4, in a case where the rear support element is moved backward.

According to the particular embodiment illustrated in FIGS. 3-5, the rear support element 23 is movably mounted with respect to the base plate 3. To this end, the rear support element is connected to the flanges 20, 21 by means of a first articulation 32, located in the area of the first fastening end 25, and by means of a second articulation 33, located in the area of the second fastening end 26. The articulations 32, 33 are substantially oriented along first 34 and second 35 transverse axes, respectively, of the binding 1. The rear support element 23 being rotatable about such axes, each articulation 32, 33 can include any component, such a screw, rivet, washer, nut, pin, or the like.

More particularly, each articulation 32, 33 enables a rotational movement of the rear support element 23 toward the base plate 3. A resulting advantage is facilitating storage of the device with the support element folded forwardly.

According to the particular embodiment being described, an abutment 40 limits the rearward rotation of the rear support element 23.

In a construction not intended to be limiting of the invention, the illustrated abutment 40 includes a linkage 41, or tie, that extends around the rear support element 23. The linkage can be considered a tie, in the sense that it ties the rear support element 23 to the base plate 3. The linkage 41 is arranged on the base plate 3 and cooperates with the rear support element 23 in order to limit the rearward rotation of the rear support element 23. The path of the linkage 41 can be seen in FIGS. 1-5. For example, the linkage 41 has a first portion or lateral portion 42 and a second portion or medial portion 43, one being co-extensive with the other. Each portion 42, 43 of the linkage 41 is connected to the base 10 by a first 44 and a second 45 lower connection, respectively. These connections 44, 45 are located in front of the first and second articulations 32, 33, respectively.

The linkage 41 can be made in the form of a wire or cable or other such element, particularly a filiform element, hereafter referred to as a cable. The cable is sufficiently flexible but is inextensible, or substantially inextensible, and can be made of metal, a metal alloy, or even a synthetic material. The cable has a first end or lateral end 46, as well as a second end or medial end 47. The ends 46, 47 are connected to the lateral flange and medial flanges 20, 21, respectively, by any means known to the one with ordinary skill in the art, so as to form the first 44 and second 45 lower connections. As an example, the use of a crimped end-piece is suitable. Between the lower connections 44, 45, the cable 41 follows each flange 20, 21 by extending away therefrom, in order to extend around the rear support element 23, in a position that is farther from the flanges.

More specifically, the first portion 42 and the second portion 43 are both connected to the rear support element 23 by first and second upper connections 48, 49, respectively, which are located between the first and second fastening ends 25, 26, respectively, of the rear support element 23 and the free end 27. In a non-limiting manner, the upper connections 48, 49 have first and second guides 50, 51, respectively.

A mechanism to adjust the angular position of the rear support element 23 with respect the base 10 or base plate 3 is also included in the illustrated embodiment. The mechanism includes an element 52, such as in the form of a relatively thin flat block as shown, affixed to the rear support element 23 on the side of the rearwardly facing free surface 31. The element 52, positioned between the guides 50, 51, retains the cable 41. The element 52 can be brought closer to the free end of the rear support element 23 or moved away therefrom. For this purpose, any immobilization arrangement known to one with ordinary skill in the art can be found suitable. Such arrangement can have a screw 53 for tightening or loosening the element 52 in relation to the rear support element 23. Toothings that are complementary to a toothing of the element 52 and to the rear support element 23 can enable a positioning of one relative to the other. These toothing configurations are well known to one skilled in the art.

Two straps for tightening the boot, removably retaining the boot on the base 10, between the flanges 20, 21, in the receiving zone 22, are also included in the retention device/binding of the illustrated embodiment of the invention.

A first strap 60 is positioned toward the front, in the area above the metatarsophalangeal joint of the foot when the foot is retained. A second strap 61 is positioned toward the rear, in the area above the instep of the foot when the foot is retained, such as over an area of the flexion crease between the foot and the lower leg of the user.

Each of the straps 60, 61 extends transversely between the flanges 20, 21.

Alternatively, a different number of straps could be provided.

The first strap 60, or front strap, has a lateral portion 62 that is removably connected to a medial portion 63 by means of a latching/unlatching device 64, or buckle.

The second strap 61, or rear strap, has a front section 65 and a rear section 66. The front section 65 of the strap 61 is positioned in front of the support surface 30 of the rear support element 23, and the rear section 66 is positioned toward the free rear surface 31 of the rear support element 23. This enables the second strap 61 to encircle the rear support element 23 at the same time it retains the foot or the boot. As a result, the rear of the lower leg is always pressed against the support surface 30 of the rear support element 23. A resulting advantage is a direct transmission of the steering impulses/forces while the lower leg is pressed against the rear support element.

Figure 2:
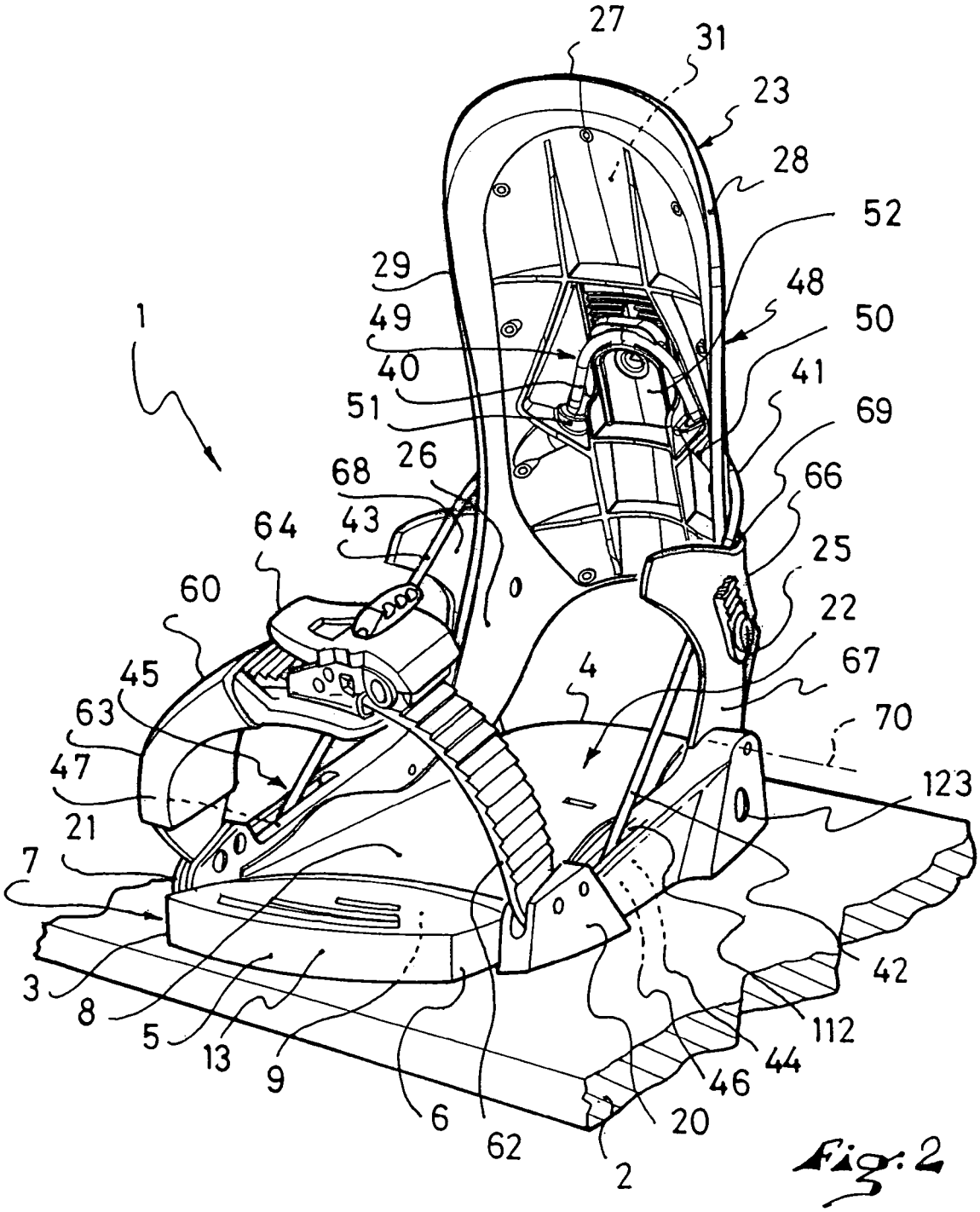
FIG. 2 is a view similar to FIG. 1, partially broken away to facilitate a better understanding of certain parts of the retaining device.

As can be seen in FIGS. 2 and 3, for example, the rear section 66 of the strap 61 has a first foot or lateral foot 67 and a second foot or medial foot 68 connected to one another by an arch or loop 69. Each of the lateral 67 and medial 68 feet is associated with the lateral 20 and medial 21 flange, respectively, for example by means of a first articulation or lateral articulation 70 having a transverse axis 71, and by means of a second articulation or medial articulation 72 having a transverse axis 73. A resulting advantage is providing the rear section 66 with a degree of rotational freedom along the transverse axes 71, 73. This facilitates the positioning of the rear section 66. The loop 69 is then more easily pressed against the free surface 31 of the rear support element 23.

The front section 65 of the rear strap 61 is shown in FIG. 1.

The front section 65 is associated with the rear section 66. It is shown in the form of a series of three portions, namely, a first fastening portion 74, a portion 75 for covering the boot, and a second fastening portion 76. The front section 65 of the rear strap can be selectively tightened or untightened and opened, by means of a reversible latching device 77. The latter is well known to one with ordinary skill in the art.

Other structures could be provided to form the second/rear strap. For example, it is possible to only keep the front section, connecting it directly to the flanges 20, 21.

According to the invention, the position of the rear support element 23 with respect to the base plate 3, and therefore with respect to the base 10, is longitudinally adjustable. Thus, it is possible to move forward or backward the position of the contact surface between the rear of the boot and the rear support element 23. Therefore, the user can select a suitable longitudinal position of the foot or of the boot. In his way, the user selects the best boot position for transmitting and receiving sensory information.

According to the particular embodiment being described, as can be generally understood by means of FIGS. 4-10, the invention includes an adjustment arrangement to enable a modification of a longitudinal position of the rear support element with respect to the base plate. Specifically, according to this particular embodiment, a first 90 and a second 91 slide, or carriage, are provided for the predeterminate selective adjustment of the longitudinal position of the support element 23 by means of the translational sliding of the slides 90, 91. The structures and functions of the slides 90, 91 are similar. Thus, the first slide 90 is described in more detail hereinafter.

The first slide 90 is an elongated element. The slide 90 extends lengthwise from a rear end 92 to a front end 93, widthwise from an outer surface 94 to an inner surface 95, and heightwise from a lower limit 96 to an upper limit 97. The first slide 90 has a generally U-shaped cross section, which can be seen in FIGS. 6 and 7. Outer 98 and inner 99 slots extend through the outer 94 and inner 95 surfaces. This arrangement lightens the slide 90 somewhat and provides it with good mechanical strength. The slide 90 can be made of metal and/or synthetic material, reinforced or non-reinforced. For example, an aluminum alloy is well suited for the slide.

The first slide 90 is movably mounted longitudinally in relation to the first flange 20. For this purpose, the slide 90 is housed in a first longitudinal cavity 110, provided in the first flange 20. The first slide 90 is longitudinally guided in the cavity 110, as the cavity 110 enables a longitudinal displacement of the slide 90. Thus, the cavity 110 has a length that is substantially greater than that of the slide 90, but a width and height that are only slightly greater. Alternative constructional arrangements for guiding the slide could also be provided. For example, the slide could be guided longitudinally on the flange.

The slide 90 can be positioned in the cavity 110 by inserting it therein from the side of the lower surface 9 of the base plate. A surface 111 of the cavity 110, a portion of the extent thereof includes a slot 112 extending therethrough, limits the depth of the insertion of the slide 90 into the cavity. A lug or catch 113 is also provided to retain the slide 90 within the cavity 110. Preferably, the catch 113 is a projection extending from the flange 20. The catch 113 is elastically displaced upon the positioning of the slide 90 in order to become housed in the outer slot 98.

In addition, an arrangement for indexing the position of the slide 90 along the longitudinal cavity 110 is provided. For example, this arrangement includes a series of striations 114, such as small indentations, disposed vertically on the outer surface 94 of the slide, as well as an inner boss 115, or projection, arranged to project into the cavity 110. The projection 115 and the striations 114 act in conjunction so that, as the slide 90 is displaced within the cavity 110, its position can be indexed, that is, retained in a position demarcated by the projection positioned within one of the striations. The indexing arrangement makes it possible to position the slide 90 more easily and more precisely.

To adjust the longitudinal position of the first slide 90, an adjustment arrangement has three openings 120, 121, 122, for example, arranged in the outer surface 94, as well as a screw 123. As seen clearly in FIG. 9, the screw 123 is screwed into the longitudinal cavity 110 by being engaged with the threads within one of the openings 120, 121, 122. The adjustment operation involves loosening the screw 123, manually displacing the slide, then tightening the screw 123 to be at least partially engaged with the slide 90 in one of the openings 120, 121, 122.

The indexing arrangement and the adjustment arrangement coordinate their effects. This means that when an opening 120, 121, 122 of the adjustment arrangement is occupied by the screw 123, the boss 115 of the cavity 110 becomes nested in a striation 114 of the slide 90.

The first fastening end 25 of the rear support element 23 is connected to the first slide 90 by the first articulation 32 having a transverse axis 34. For this purpose, in the area of the first slide 90, the articulation 32 has a circular opening 124 provided in the inner surface 95, in the vicinity of the rear end 92. To connect the first fastening end 25 to the slide 90, the first articulation 32 also has a pin 125.

Thus, in the area of the first fastening end 25, the rear support element 23 is connected to the first flange 20 by means of the first slide 90. The connection of the rear support element 23 to the flange 20, and therefore to the base plate 3, is consequently an indirect connection, the slide 90 bearing the first fastening end 25 of the rear support element 23.

The same is true in the area of the second fastening end 26. The second slide 91 is longitudinally guided in a cavity 130 of the second flange 21. The second fastening end 26 of the rear support element 23 is connected to the second slide 91 by the second articulation 33 having a transverse axis 35.

Thus, in the area of the second fastening end 26, the rear support element 23 is connected to the second flange 21 by means of the second slide 91. Here again, the connection of the rear support element 23 to the flange 21, and therefore to the base plate 3, is an indirect connection, the slide 91 bearing the second fastening end 26 of the rear support element 23.

It is possible to displace the slides 90, 91 independently of one another.

FIGS. 4, 5, and 9 correspond to situations for which the slides 90, 91 are substantially opposite one another, symmetrically with respect to a longitudinal vertical median plane of the binding 1. That is, their longitudinal positions are the same. Consequently, the first 25 and second 26 fastening ends of the rear support element 23 are facing one another along a transverse direction of the binding 1. As a result, the rear support element 23 is substantially centered on the rear of the lower leg, when the lower leg is positioned in the binding 1. This enables the user to apply precise forces in a rear longitudinal direction. In the case where the binding 1 is oriented transversely with respect to the snowboard 2, edge setting is easier because the forces are oriented perpendicular, or substantially perpendicular, to the snowboard 2.

The user can bring the rear support element 23 either forward, according to FIG. 4, or rearward, according to FIG. 5, or yet in an intermediate position, according to FIG. 9. Thus, the binding 1 is adjustable lengthwise. This enables the user to take into account his/her size, weight, shoe size, steering style, or the quality of the snow or terrain.

Conversely, FIG. 10 corresponds to a situation where the slides 90, 91 are longitudinally offset. Consequently, the first 25 and second 26 fastening ends are offset. As a result, the rear support element 23 is offset on the rear of the lower leg, when the lower leg is in the binding 1. This enables the user to apply precise forces in a direction that is offset with respect to the rear longitudinal direction. The user can offset the rear support element 23 in order to compensate for an off-centering of the binding 1 in relation to the snowboard 2. Consequently, the user can still orient his/her rear support forces perpendicularly to the snowboard 2.

This multiplicity of adjustments is possible because the rear support element 23 can be displaced longitudinally in the area of at least one 28, 29 of its edges.

In the manner of the fastening ends 25, 26 of the rear support element 23, the linkage 41 is indirectly connected to the base plate 3 by the lower connections 44, 45. The first end 46 of the first portion 42 of the linkage 41 is connected to the first slide 90, preferably in the area of its front end 93. Similarly, the second end 47 of the second portion 43 of the linkage 41 is connected to the second slide 91, preferably in the area of its front end. As a result, each of the slides 90, 91 is connected to a fastening end 25, 26 of the rear support element 23, as well as to a portion 42, 43 of the linkage 41. In other words, the binding 1 has an arrangement for displacing the rear support element 23 simultaneously with the linkage 41.

The spacing is constant between an articulation 32, 33 of a fastening end 25, 26 and an end 46, 47 of the linkage 41. This enables the user to adjust the longitudinal position of a slide 90, 91, and therefore of an edge 28, 29 of the rear support element 23, without changing the angular position along a transverse axis of the support element 23.

In other words, for the rear support element 23, the adjustment of the longitudinal position and the inclination adjustment along a transverse axis are independent. This prevents one adjustment from disturbing the other. A resulting advantage is being capable of modifying one parameter associated with the steering of the board without affecting another parameter.

Generally speaking, the invention is made from materials and according to manufacturing techniques that are known to one skilled in the art.

The invention is not limited to the particular embodiment shown and described, and encompasses all of the technical equivalents that fall within the scope of the claims that follow.

In particular, other means for adjusting the longitudinal position of the rear support element, as well as other structures for the slides 90, 91 or for the linkage 41 or for the straps 60, 61 can be provided. Moreover, merely a single slide can be provided, in a central or lateral position.

One can also provide the arrangement for adjusting the longitudinal position of the rear support element to be independent of the arrangement for adjusting the longitudinal position of the linkage 41 of the abutment 40. For example, two distinct slides can be positioned in the same longitudinal cavity of a flange. In this case, the longitudinal displacement of the rear support element 23 is independent of the linkage 41.

The articulations 32, 33 that connect the rear support element 23 to the slides 90, 91 are different from the articulations 70, 72 that connect the rear strap 61 to the flanges 20, 21. Thus, the strap 61 can move neither forward nor backward.

However, it is within the scope of the invention to arrange the articulation 70, 72 of the strap 61 to be connected to the slides 90, 91. In that case, the strap 61 would follow the movements of the slides.

What is claimed is:

1. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation;

a tie extending between the base plate and the rear support element to limit rearward articulated movement of the rear support element relative to the base plate, the tie having a first portion and a second portion, the first and second portions of the tie being connected to the base by a first and second lower connection, respectively, the first and second lower connection being located in front of the first and second articulations;

an adjustment arrangement to enable a modification of a longitudinal position of an entirety of the rear support element with respect to the base plate.

2. A device according to claim 1, further comprising:

an arrangement to enable a predeterminate displacement of the rear support element simultaneously with the tie.

3. A device according to claim 1, wherein:

the adjustment arrangement enables a predeterminate longitudinal displacement of the rear support element in an area of at least one of two transversely opposite edges of the rear support element.

4. A device according to claim 1, further comprising:

a flange positioned at one of the edges of the base plate;

a slide mounted for at least substantially longitudinal translational displacement with respect to the flange, the slide connected to a fastening end of the rear support element;

the adjustment arrangement comprising a structure to adjust the longitudinal position of the slide.

5. A device according to claim 4, wherein:

an end of a portion of the tie is connected to the slide.

6. A device according to claim 5, wherein:

the slide is a first slide;

the end of the portion of the tie is a first end of a first portion of the tie;

the device further comprising:

a second flange positioned at a second of the edges of the base plate;

a second slide mounted for longitudinal displacement with respect to the second flange, the second slide connected to a second fastening end of the rear support element;

the adjustment arrangement comprising a structure to adjust the longitudinal position of the second slide.

7. A device according to claim 6, wherein:

a second end of a second portion of the tie is connected to the second slide.

8. A device according to claim 4, further comprising:

a structural arrangement for the slide to index the slide in selective predeterminate longitudinal respective positions.

9. A device according to claim 4, further comprising:

a catch to retain the slide from becoming removed from a sliding connection with the flange.

10. A device according to claim 1, wherein:

the device is a snowboard binding for retaining a snowboard boot on a snowboard.

11. A device according to claim 1, further comprising:

an assembly to mount the base plate to the sports apparatus.

12. A device according to claim 11, wherein:

the base plate comprises a through opening in a thickness of the base plate;

the assembly to mount the base plate to the sports apparatus comprises a disk adapted to be positioned within and to be engaged with a periphery of the opening of the base plate, and a plurality of screws adapted to extend through holes in the disk and into the sports apparatus.

13. A device according to claim 1, wherein:

the device further comprises a first longitudinally extending flange extending upwardly with respect to the first edge of the base plate and a second longitudinally extending flange extending upwardly with respect to the second edge of the base plate;

the device does not include a heel loop extending rearwardly from rear ends of the first and second flanges to limit rearward articulated movement of the rear support element relative to the base plate during use of the device.

14. A device according to claim 1, wherein:

the adjustment arrangement comprises a structure to enable a substantially longitudinal translational displacement of the rear support element with respect to the base plate.

15. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation;

a tie extending between the base plate and the rear support element to limit rearward articulated movement of the rear support element relative to the base plate, the tie having a first portion and a second portion, the first and second portions of the tie being connected to the base by a first and a second lower connection, respectively, the first and second lower connection being located in front of the first and second articulations;

an adjustment arrangement to enable a modification of a longitudinal position of the rear support element with respect to the base plate, the adjustment arrangement enabling a predeterminate longitudinal displacement of the rear support element independent of the tie.

16. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation;

a tie extending between the base plate and the rear support element to limit rearward articulated movement of the rear support element relative to the base plate, the tie having a first portion and a second portion, the first and second portions of the tie being connected to the base by a first and a second lower connection, respectively, the first and second lower connection being located in front of the first and second articulations;

an adjustment arrangement to enable a modification of a longitudinal position of the rear support element with respect to the base plate;

a first flange positioned at the first edge of the base plate;

a second flange positioned at the second edge of the base plate;

a first slide mounted for longitudinal displacement with respect to the first flange, the first slide being connected to a first fastening end of the rear support element;

a second slide mounted for longitudinal displacement with respect to the second flange, the second slide being connected to a second fastening end of the rear support element;

the adjustment arrangement comprising a structure to adjust the longitudinal position of the first slide and a structure to adjust the longitudinal position of the second slide;

a first end of a first portion of the tie being connected to the first slide;

a second end of a second portion of the tie is connected to the second slide;

the first and second portions of the tie being co-extensive;

the tie extending around the rear support element in a position most remote from the first and second flanges.

17. A device according to claim 16, wherein:

the first slide is positioned in a longitudinally extending cavity of the first flange;

the second slide is positioned in a longitudinally extending cavity of the second flange;

the first slide comprises a plurality of longitudinally spaced apart openings; the second slide comprises a plurality of longitudinally spaced apart openings;

a screw extends from the first flange and into the cavity of the first flange and is screwed into one of the openings of the first slide;

a screw extends from the second flange and into the cavity of the second flange and is screwed into one of the openings of the second slide.

18. A device according to claim 17, wherein:

a respective catch is positioned within each of the longitudinal cavities of the first and second flanges to retain the first and second slides within said longitudinal cavities, respectively.

19. A device according to claim 16, further comprising:

a structural arrangement for each of the first and second slides to index the first and second slides in selective predeterminate longitudinal respective positions.

20. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation;

a tie extending between the base plate and the rear support element to limit rearward articulated movement of the rear support element relative to the base plate, the tie having a first portion and a second portion, the first and second portions of the tie being connected to the base by a first and a second lower connection, respectively, the first and second lower connection being located in front of the first and second articulations;

an adjustment arrangement to enable a modification of a longitudinal position of the rear support element with respect to the base plate;

a front retention strap extending transversely between the first and second edges of the base plate, the front strap being positioned in an area adapted to be vertically above a metatarsophalangeal joint of a user's foot retained on the base plate of the device; and a rear retention strap extending transversely between the first and second edges of the base plate, the rear strap being positioned in an area vertically above an instep of the foot when the foot is retained on the base plate of the device.

21. A device according to claim 20, wherein:

the device further comprises a first longitudinally extending flange extending upwardly with respect to the first edge of the base plate and a second longitudinally extending flange extending upwardly with respect to the second edge of the base plate;

the rear retention strap includes a first foot and a second foot connected by articulations to respective ones of the first and second flanges;

the device does not include a heel loop extending rearwardly from rear ends of the first and second flanges to limit rearward articulated movement of the rear support element relative to the base plate during use of the device.

22. A device according to claim 21, wherein:

the first foot and the second foot are connected to one another by a rear section of the rear retention strap, said rear section of the rear retention strap adapted to be pressed against a rear surface of the rear support element during tightening of the rear retention strap during use of the device, and, during tightening of the rear retention strap during use of the device, a lower leg of a user is adapted to be pressed against a forward support surface of the rear support element.

23. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation;

a tie extending between the base plate and the rear support element to limit rearward articulated movement of the rear support element relative to the base plate, the tie having a first portion and a second portion, the first and second portions of the tie being connected to the base by a first and a second lower connection, respectively, the first and second lower connection being located in front of the first and second articulations;

an adjustment arrangement to enable a modification of a longitudinal position of the rear support element with respect to the base plate;

a medial flange extending upwardly from the first edge of the base plate and a lateral flange extending upwardly from the second edge of the base plate;

a strap extending transversely between the first and second edges of the base plate for retaining a boot on the base plate;

the strap having a medial foot connected to the medial flange by means of a first articulation extending along a transverse axis, and a lateral foot connected to the lateral flange by means of a second articulation extending along the transverse axis.

24. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation;

a tie extending between the base plate and the rear support element to limit rearward articulated movement of the rear support element relative to the base plate, the tie having a first portion and a second portion, the first and second portions of the tie being connected to the base by a first and a second lower connection, respectively, the first and second lower connection being located in front of the first and second articulations;

an adjustment arrangement to enable a modification of a longitudinal position of the rear support element with respect to the base plate, the adjustment arrangement enabling a predetermined longitudinal displacement of the rear support element parallel to an upper support surface of the base plate.

25. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation;

a tie extending between the base plate and the rear support element to limit rearward articulated movement of the rear support element relative to the base plate, the tie having a first portion and a second portion. the first and second portions of the tie being connected to the base by a first and a second lower connection, respectively, the first and second lower connection being located in front of the first and second articulations;

an adjustment arrangement to enable a modification of a longitudinal position of the rear support element with respect to the base plate;

a flange positioned at one of the edges of the base plate;

a slide mounted for longitudinal displacement with respect to the flange, the slide connected to a fastening end of the rear support element;

the adjustment arrangement comprising a structure to adjust the longitudinal position of the slide;

an end of a portion of the tie being directly connected to the slide.

26. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate, the articulation mechanism comprising a first articulation and a second articulation, said first and second articulations being widthwise spaced apart;

a linkage extending from the rear support element to widthwise spaced-apart positions adjustably fixed longitudinally relative to the base plate, forward of respective ones of said first and second articulations, to limit rearward articulated movement of the rear support element relative to the base plate;

an adjustment arrangement to enable a longitudinal positional adjustment of an entirety of the rear support element with respect to the base plate.

27. A device according to claim 26, wherein:

the linkage comprises a filiform element.

28. A device according to claim 26, wherein:

the adjustment arrangement comprises a structure to enable a substantially longitudinal translational displacement of the rear support element with respect to the base plate.

29. A device according to claim 26, further comprising:

a flange positioned at one of the edges of the base plate;

a slide mounted for at least substantially longitudinal translational displacement with respect to the flange, the slide connected to a fastening end of the rear support element;

the adjustment arrangement comprising a structure to adjust the longitudinal position of the slide.

30. A device for retaining a foot or boot on a sports apparatus, the device comprising:

a base plate extending lengthwise from a rear end to a front end and widthwise from a first edge to a second edge;

a rear support element and an articulation mechanism mounting the rear support element to articulate with respect to the base plate;

a linkage extending between the base plate and the rear support element to limit rearward articulated movement of the rear support element relative to the base plate;

an adjustment arrangement to enable a modification of a longitudinal position of the rear support element with respect to the base plate;

a first flange positioned at the first edge of the base plate;

a second flange positioned at the second edge of the base plate;

a first slide mounted for longitudinal displacement with respect to the first flange, the first slide connected to a first fastening end of the rear support element;

a second slide mounted for longitudinal displacement with respect to the second flange, the second slide connected to a second fastening end of the rear support element;

the adjustment arrangement comprising a first structure to adjust the longitudinal position of the first slide and a second structure to adjust the longitudinal position of the second slide;

a first end of a first portion of the linkage being connected to the first slide;

a second end of a second portion of the linkage being connected to the second slide;

the first and second portions of the linkage being co-extensive;

the linkage extending around the rear support element in a position most remote from the first and second flanges;

the first slide being positioned in a longitudinally extending cavity of the first flange;

the second slide being positioned in a longitudinally extending cavity of the second flange;

the first slide comprising a plurality of longitudinally spaced apart openings;

the second slide comprising a plurality of longitudinally spaced apart openings;

a screw extending from the first flange and into the cavity of the first flange and being screwed into one of the openings of the first slide;

a screw extending from the second flange and into the cavity of the second flange and being screwed into one of the openings of the second slide.

31. A device according to claim 30, wherein:

a respective catch is positioned within each of the longitudinal cavities of the first and second flanges to retain the first and second slides within said longitudinal cavities.

* * * * *